US006012361A

United States Patent [19]

Wooster, Jr. et al.

[11] Patent Number: 6,012,361

[45] **Date of Patent: *Jan. 11, 2000**

[54] LOCKING PLIERS WRENCH

[75] Inventors: Robert D. Wooster, Jr., Crystal Lake; Charles Martinka, Berwyn, both of Ill.

[73] Assignee: Adjustable Clamp Company, Chicago, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/010,346

[22] Filed: Jan. 22, 1998

[51] Int. Cl.[7] ..... B25B 7/12

[52] U.S. Cl. ..... 81/367; 81/370

[58] Field of Search ..... 81/375, 367, 370, 81/377, 385, 389

[56] References Cited

U.S. PATENT DOCUMENTS

| | | | |
|---|---|---|---|
| 2,627,774 | 2/1953 | Walter | 81/368 |
| 2,853,910 | 9/1958 | Petersen | 81/368 |
| 5,056,385 | 10/1991 | Petersen | 81/367 |
| 5,460,065 | 10/1995 | Balmer | 81/368 |
| 5,609,080 | 3/1997 | Flavigny | 81/368 |

*Primary Examiner*—James G. Smith
*Assistant Examiner*—Lee Wilson
*Attorney, Agent, or Firm*—Cook, Alex, McFarron, Manzo, Cummings & Mehler, Ltd.

[57] ABSTRACT

A locking pliers wrench adjustable to grip between two jaws and lock onto objects in a range of sizes. An elongated handle forms the body of the wrench. The rear portion of the handle is channel-shaped in cross section and houses a gripping size adjusting screw and a jaw actuating slider actuated thereby. One jaw is rigidly mounted on the fore end of the handle while the second jaw is pivotally mounted on the handle at a first point adjacent the rear end of the first jaw. A second handle extends generally parallel to the body forming first handle and is pivotally connected to the second jaw at a second pivot point spaced from the first pivot point. A link connects the second handle with the fore end of the jaw actuating slider. The adjusting screw is free to rotate but is restrained from axial movement. A nut is locked in the rear end of the slider so as to receive the threaded shank of the screw. The rear portion of the screw rotatably engages the rear end of the body forming handle. Rotation of the screw shifts the slider in opposite directions in the body forming handle and in turn adjusts the size of the gripping opening between the two jaws.

7 Claims, 4 Drawing Sheets

LOCKING PLIERS WRENCH

BACKGROUND AND DESCRIPTION OF THE INVENTION

This invention relates to innovations and improvements in hand tools which in part are similar to so-called "pliers" and in part are similar to wrenches. More particularly the invention relates to plier wrenches which are self-locking but which may be readily released from the locking condition. One form of this tool which has been commercially available on the market for a number of years is sold under the trademark VISE GRIP.

While lockable pliers wrenches may be made in different sizes, for practical purposes, any one particular size must exhibit some range of adjustability in order to be able to grip and lock onto objects within a rather wide size range. Accordingly, these tools must incorporate a size adjusting feature to accommodate objects of different sizes within a particular range.

In the VISE GRIP tool, which is perhaps the most popular tool of this general type, object gripping size adjustment is obtained by turning an adjusting screw which moves axially and causes this tool to assume its shortest overall length when it is at the small end of its gripping range and to substantially increase its overall length when adjusted to the large end of its gripping range. Depending upon the dimensions of the particular space in which the tool is being used, the substantial increase in overall tool length may limit the utility of the tool in tight or confined situations.

The object of the invention, generally stated, is the provision of locking pliers wrenches which are adjustable to grip objects in a range of sizes and which are economical to produce from economical components and which has a size adjusting screw which does not move axially in operation.

Certain other objects of the invention will be in part obvious and in part appear hereinafter. For a more complete understanding of the nature and scope of the invention reference may be had to the accompanying drawings in which:

DETAILED DESCRIPTION OF THE INVENTION

Referring to FIGS. 1–4, a locking pliers wrench forming one embodiment of the invention is indicated generally at 5. This tool is adjustable so as to be able to grip objects in one particular range of sizes or diameters. The wrench 5 can be made in different sizes so as to be able to grip or lock onto objects in several different size ranges.

Figure 5:
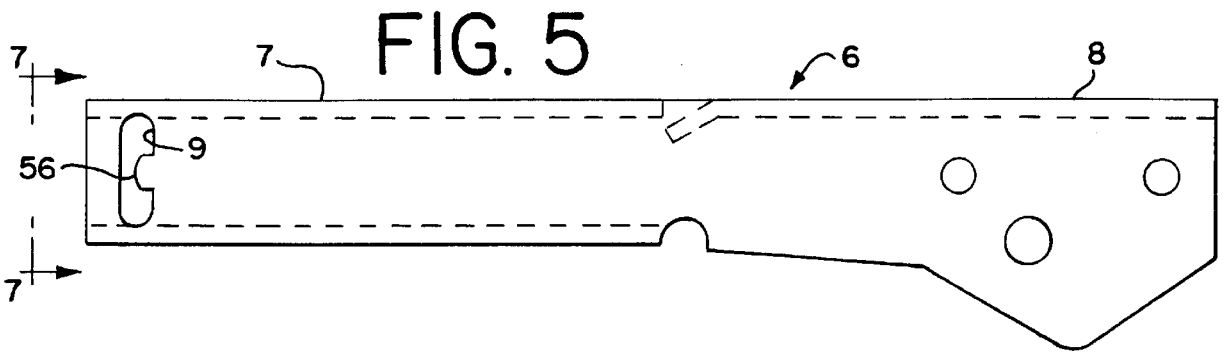
FIG. 5 is a side elevational view of the handle forming the main frame of the tool shown in FIGS. 1–4.
Figure 6:
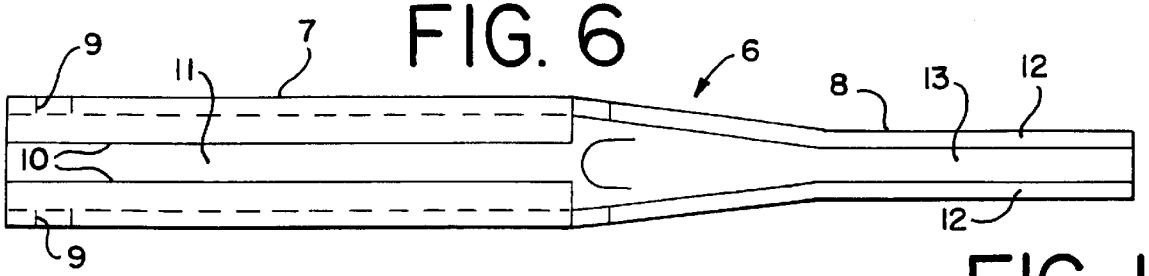
FIG. 6 is a bottom plan view of FIG. 5.
Figure 7:
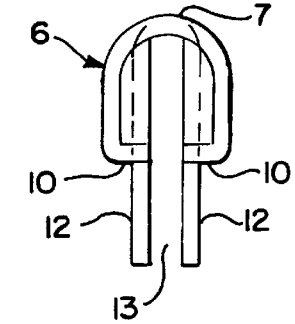
FIG. 7 is an end elevational view taken on lines 7—7 of FIG. 5.

The body of the wrench 5 is formed by an elongated handle indicated generally at 6 in FIGS. 5–7 comprising a grippable rear portion 7 and a non-grippable jaw supporting fore portion 8. The handle 6 is channel shaped in transverse cross section. The bottom edges 10 of the grippable handle portion 7 are inturned so as to form an elongated slot 11 therebetween. The sides 12 of the handle fore portion 8 are straight and form a slot 13 therebetween.

Figure 11:
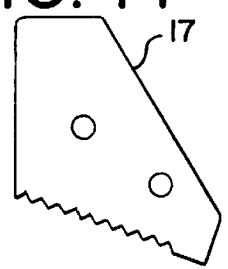
FIG. 11 is a side elevational view of an outside stationary jaw element.
Figure 10:
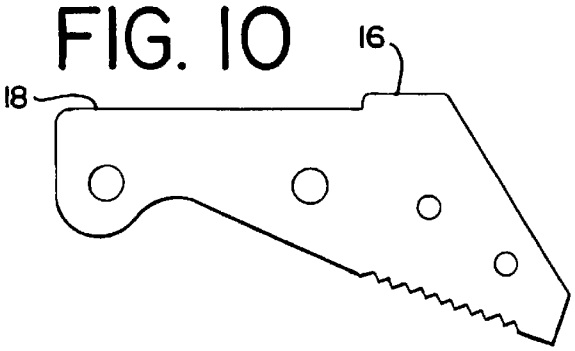
FIG. 10 is a side elevational view of an inside stationary jaw element forming part of the stationary jaw of the tool shown in FIGS. 1–4.
Figure 9:
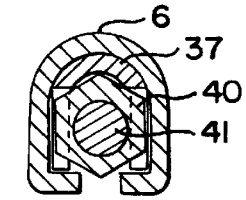
FIG. 9 is a vertical sectional view taken on line 9—9 of FIG. 1.

As shown in FIGS. 1–4 the fore or nose end of the wrench 5 is provided with a stationary jaw indicated generally at 14 and a moveable jaw indicated generally at 15. The jaws 14 and 15 are mounted on the fore portion 8 of the handle 6. In the tool or wrench 5 the stationary jaw 14 is formed by an inside jaw element 16 (FIG. 10) and a pair of outside jaws elements 17 (FIG. 11). The rear portion 18 of the inside stationary jaw element 16 fits in the slot 13 in the handle 6 while the outside stationary jaws elements 17 fit on opposite sides of the protruding end of the stationary jaw element 16 which projects beyond the end of the handle 6.

Figure 1:
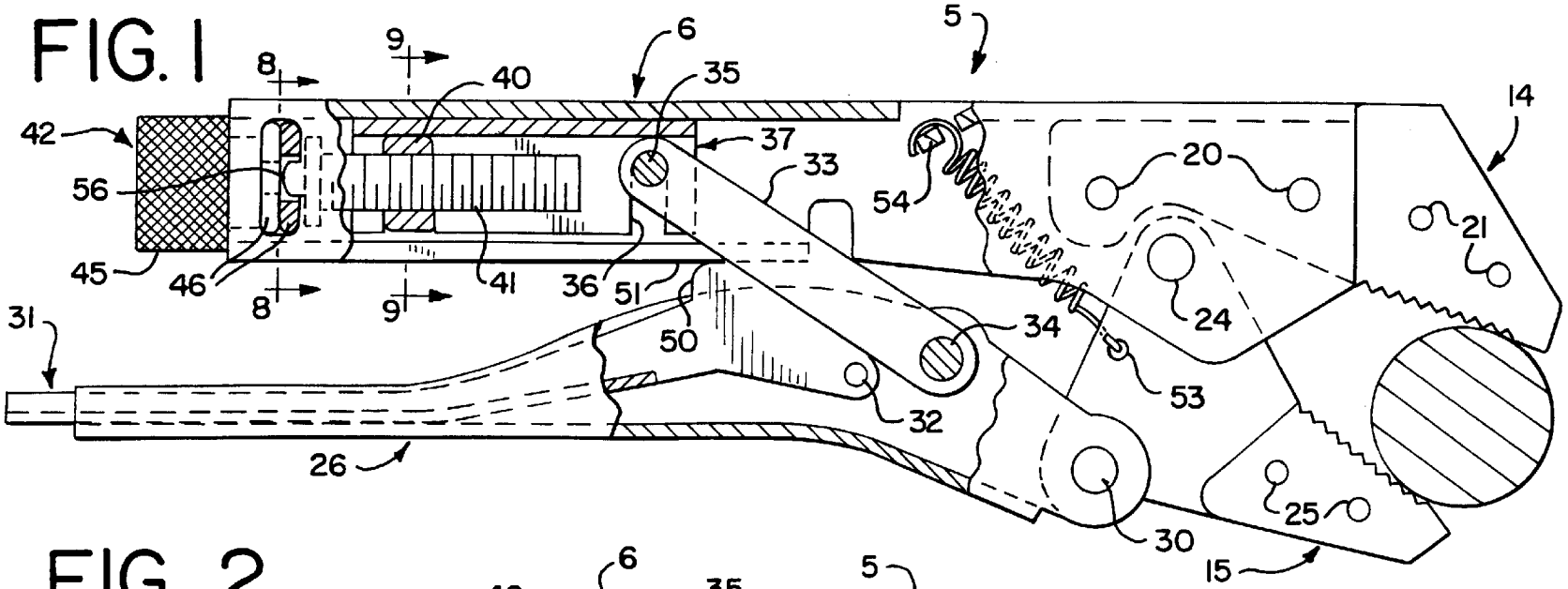
FIG. 1 is a side elevational view, partly broken away, of a locking pliers wrench embodying the invention and showing the tool locked onto a round object gripped between its jaws.
Figure 2:
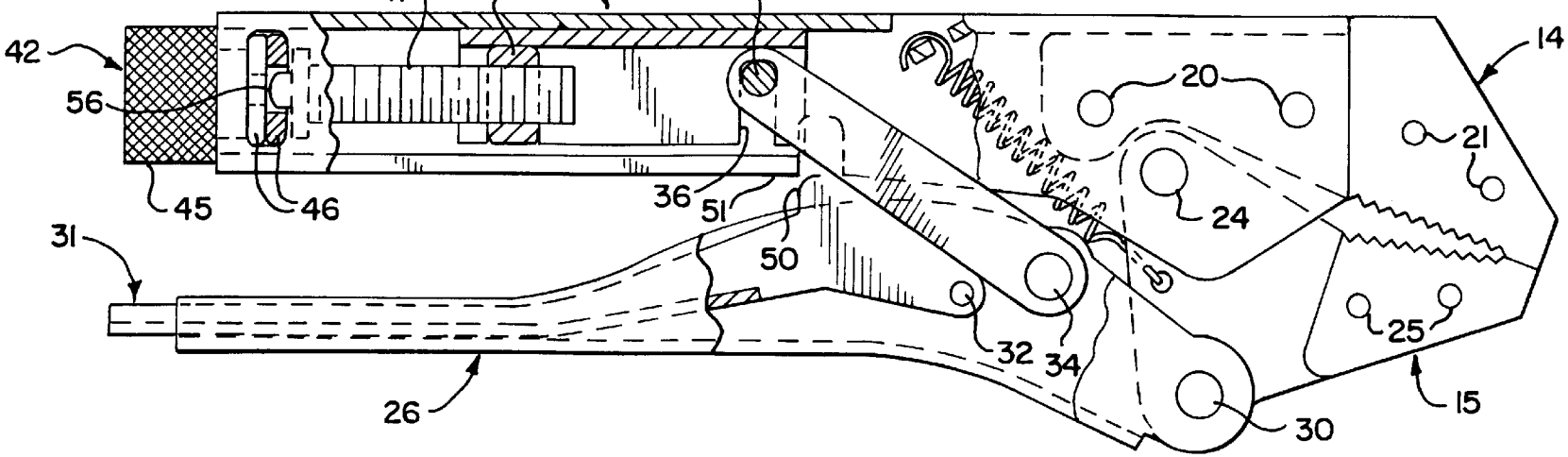
FIG. 2 is side elevational view, partly broken away, showing the tool of FIG. 1 in its closed condition.
Figure 4:
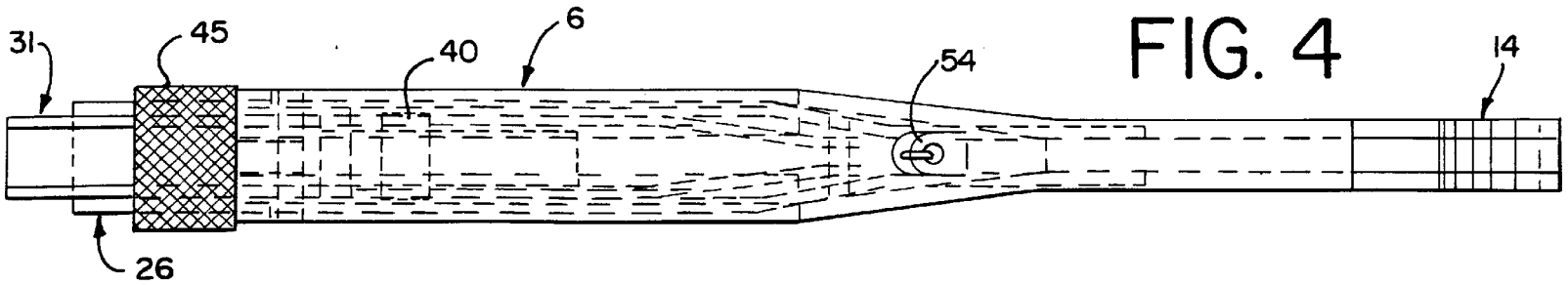
FIG. 4 is a top plan view taken on line 4—4 of FIG. 3.
Figure 3:
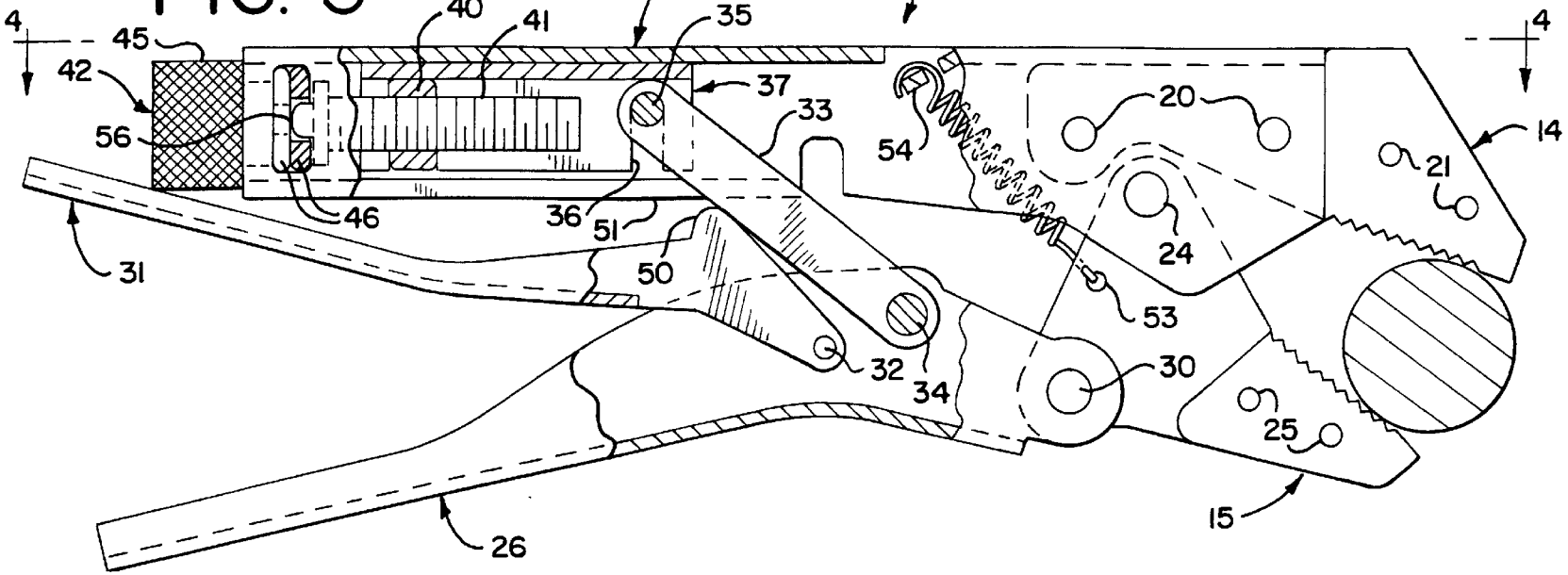
FIG. 3 is a side elevational view corresponding to FIG. 1 showing the tool of FIG. 1 in its released condition.

The rear portion 18 of the inside stationary jaw element 16 that fits within the slot 13 is secured in place by rivets 20—20 (FIGS. 1–3). The outside stationary jaw elements 17 are secured to opposite sides of the inside stationary jaw element 16 by a pair of rivets 21—21.

Figure 12:
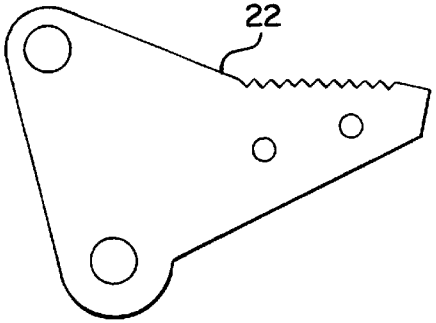
FIG. 12 is a side elevational view of an inside moveable jaw element forming part of the moveable jaw of the tools of FIGS. 1–4.
Figure 13:
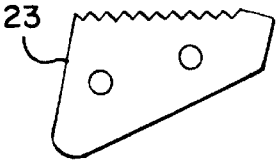
FIG. 13 is a side elevational view of an outside moveable jaw element.
Figure 17:
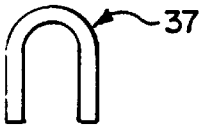
FIG. 17 is an end elevational view taken on line 17—17 of FIG. 16.

The moveable jaw 15 is formed by an inside jaw element 22 (FIG. 12) and a pair of outside jaw elements 23—23 (FIG. 13). The rear portion of the inside moveable jaw element 22 fits in the slot 13 (FIG. 6) and is pivotally mounted onto the fore portion of the handle 6 by a rivet pin 24 as shown in FIGS. 1–3. The outside moveable jaw elements 23 are secured on opposite sides of the inside jaw element 22 by rivets 25—25 (FIGS. 1–3).

Co-operable with the handle 6 is a tool operating handle indicated generally at 26 in FIGS. 1–4, 14 and 15. The handle 26 is channel shaped in transverse cross section and has a grippable rear portion 27 and a fore portion 28 (FIGS. 14 and 15) the latter being narrower than the rear grippable portion 27. The fore portion 28 fits over the rear of the inside moveable jaw member 22 and is pivotally connected thereto by a pivot pin 30 as shown in FIGS. 1–3. A release lever indicated generally at 31 (FIGS. 1–3, 14 and 15) is nestable within the handle 26 and is pivotally connected thereto by a rivet pin 32.

Figure 16:
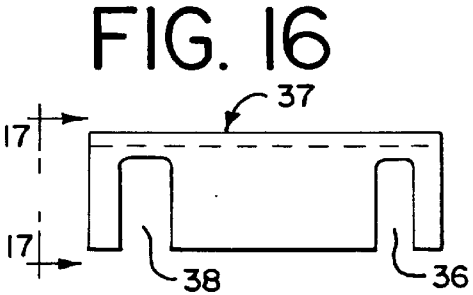
FIG. 16 is a side elevational view of a carrier element forming one of the moveable parts of the tool of FIGS. 1–4.

The handle 26 is operatively connected with the handle 6 by means of a link 33 (FIGS. 1–3). One end of the link 33 fits within the fore portion 28 of the handle 26 and is pivotally connected thereto by a rivet pin 34. The opposite end of the link 33 is pivotally connected by a pin 35 (FIGS. 1–3) mounted in a slot 36 in the fore end of a slider or carrier indicated generally at 37 in FIGS. 1–3, 16 and 17. The slider 37 is channel shaped in transverse cross section and is slidably nested within the grippable rear portion 7 of the handle 6. As shown in FIG. 16 the slider 37 in addition to the slot 36 in its fore end has a slot 38 at its rear end. As shown in FIGS. 1–4 and 9 an ordinary hex nut 40 fits in the slot 38. The nut 40 receives the threaded shank portion 41 of an adjusting screw indicated generally at 42 in FIGS. 1–4 and 18.

In addition to its threaded shank 41 the screw 42 has integrally formed spaced collars 43 and 44. The rear end of the screw 42 is formed by a knurled knob 45. The inner face of the knob 45 engages and rotates against the rear end of the handle 6 as shown in FIGS. 1–3. The screw 42 is secured in place within the handle 6 against axial shifting removement therein by means of interfitting keepers 46 (FIGS. 1–4 and 19).

The fore or nose end of the release lever 31 has an integrally formed cam 50 (FIGS. 1, 2 and 14) which engages the handle 6 at 51.

The moveable jaw 15 is continually biased in a clockwise (open) direction as viewed in FIGS. 1 and 3 by a tension spring 52. One end of the spring 52 is secured in the opening 53 (FIGS. 1–3) formed in the moveable jaw 15 while the opposite end of the spring is secured over a hook 54 integrally formed by punching through the bight of the handle 6.

Figure 8:
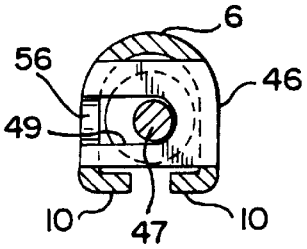
FIG. 8 is a vertical sectional view taken on line 8—8 of FIG. 1.
Figure 14:
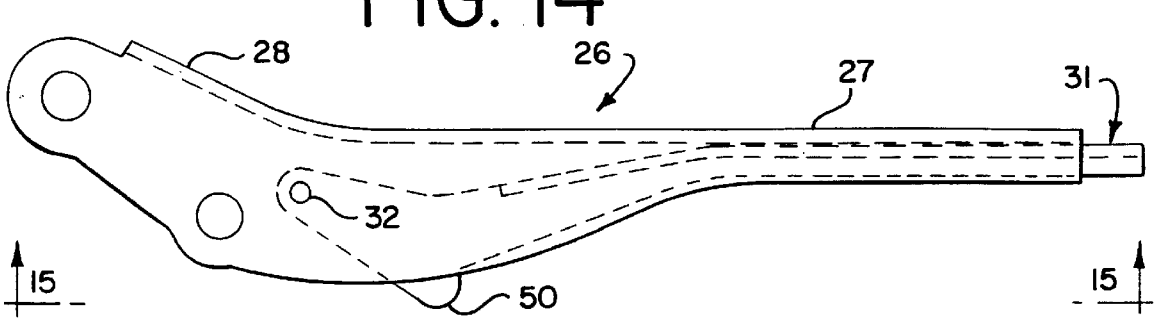
FIG. 14 is a side elevational view showing the actuating handle of the tool shown in FIGS. 1–4 with the release lever of the tool pivotally attached thereto.
Figure 15:
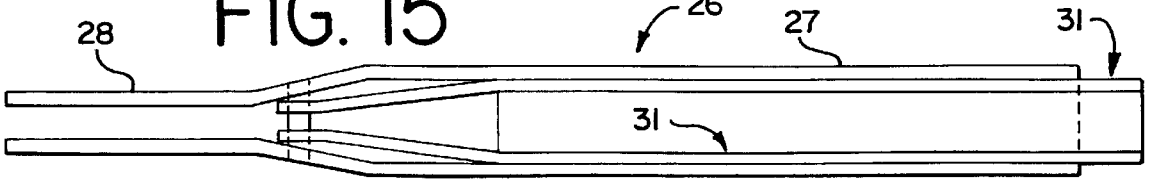
FIG. 15 is a plan view taken on line 15—15 of FIG. 14.
Figure 19:
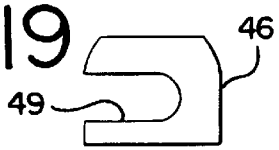
FIG. 19 is an elevational view of one of two keeper elements forming part of the tool of FIGS. 1–4.
Figure 18:
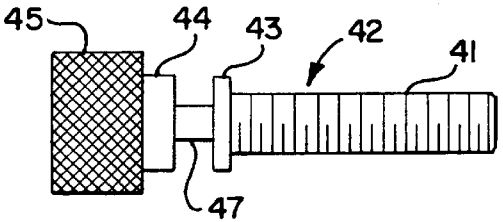
FIG. 18 is a side elevational view of an adjusting screw forming one of the parts of the tool of FIGS. 1–4.

The adjusting screw 42 is allowed to rotate freely while restrained from axial movement by means of two keepers 46 (FIG. 19) pressed into the aligned openings 9—9 (FIGS. 5 and 6) formed in opposite sides of the handle 6 while leaving tabs 56 in the front sides of the openings. The keepers 46 can be metal stampings formed with elongated slots 49 dimensioned to fit over the reduced diameter section 47 (FIG. 18) of the screw 42 between the spaced collars 43 and 44 as shown in FIGS. 1, 2 and 8. The keepers or inserts 46 are inserted into the openings 9 from opposite sides of the handle 6 with the slot 49 in the front insert 46 fitting over the tab 47.

In operation, when the adjusting screw 42 is rotated so as to slide the slider 37 to its foremost (i.e. inner) position in the handle 6 (as shown in FIG. 2) the jaws 14 and 15 will be closed or substantially closed together. Conversely, when the screw 42 is rotated so as to withdraw or shift the slider 37 to its rearmost position (as shown in FIGS. 1 and 3) the jaws 14 and 15 will be opened to the maximum extent permitted for the wrench or tool 5. It will be understood that when the slider 37 is in intermediate positions within the handle 6 the opening between the jaws 14 nd 15 will be between fully closed and fully open.

In order to clench an object 55 between the jaws 14 and 15 as shown at 55 in FIG. 2 the jaws are opened wider than the dimension of the object to be clenched by pivoting the handle 26 away from the handle 6. During this opening movement the handle 26 rotates on the pin 30 in a counter clockwise direction as viewed in FIGS. 1–3. When the jaws 14 and 15 have been opened sufficiently they may be closed together by moving the handles 26 and 6 so as to cause the link mechanism 43 to pass over center thereby temporarily locking the handles 6 and 26 and the jaws 14 and 15 in their closed positions with respect to the clenched object.

In order to release the tool or wrench 5 from its locked condition, the release lever 31 is rotated clockwise as viewed in FIGS. 1–3 causing the cam 50 to ride over the point 51 and force the mechanism over-center in the opposite direction thereby opening the wrench 5 and releasing the clenched object.

What is claimed is:

1. In a locking pliers wrench adjustable to grip objects in a range of sizes comprising, a straight elongated body-forming first handle having a grippable rear portion and a non-grippable jaw supporting fore portion, said grippable handle portion being channel-shaped in transverse cross-section with the edges of the opposing sides inturned to form an elongated slot therebetween, a first jaw rigidly mounted on the distal end of said non-grippable handle portion in straight alignment therewith, a moveable second jaw pivotally mounted in off-set relationship on the distal end of said non-grippable handle portion at a first pivot point adjacent the rear of said first jaw so as to cooperate therewith in clenching objects therebetween, and a second handle extending in generally parallel spaced relationship to said first handle and having a grippable rear portion cooperable with said grippable rear portion of said first handle and a non-grippable fore portion the end of which is pivoted on said second moveable jaw at a second pivot point spaced from said first pivot point, mechanism for operatively interconnecting said first and second handles for actuating said jaws, comprising, a link pivotally connected at one end to said second handle at a third pivot point rearwardly of said second pivot point, a screw actuated slider which is channel shaped in transverse cross-section sideably disposed within said grippable portion of said first handle, the end of said link opposite said one end thereof being pivotally connected at a fourth pivot point to the fore end of said slider, a nut trapped in said slider rearwardly of the fore end thereof, a screw disposed in the rear end of said first handle with the rear end thereof located outside said first handle and having rotatable bearing engagement with the rear end thereof and with the threaded shank of said screw having threaded engagement with said nut, and screw restraining means disposed in the rear end of said first handle and operatively connected with said screw to prevent axial movement of said screw relative to said first handle.

2. In the locking pliers wrench called for in claim 1, a tension spring interconnecting said moveable jaw with said first handle so as to bias said first and second jaws toward their open condition.

3. In the locking pliers wrench called for in claim 1, a release lever pivotally mounted on said second handle at a fifth pivot point and operable to spread apart said first and second handles and thereby release said wrench from its locked condition.

4. In the locking pliers wrench called for in claim 1 said second handle being channel shaped in transverse cross section.

5. In the locking pliers wrench called for in claim 1, a pivot pin seated transversely in a slot located in the fore end of said slider providing said fourth pivot point and said nut being in the form of a commercial nut seated transversely in a slot located in the rear end of said slider.

6. In the locking pliers wrench called for in claim 1 wherein said screw restraining means comprises at least one opening in one side of said handle adjacent its rear end and at least one keeper inserted into said opening and operatively engaging said screw and restraining axial movement of said screw while not restraining rotation thereof.

7. In the locking pliers wrench called for in claim 6, two of said at least one opening in opposite sides of said handle in transverse alignment, and two of said at least one keeper inserted into said openings in opposite directions in side by side relationship, each said keeper having an elongated slot which fits over a reduced diameter portion of said screw.

* * * * *